US005897808A

United States Patent [19]

Kim

[11] Patent Number: 5,897,808

[45] Date of Patent: Apr. 27, 1999

[54] MICROWAVE OVEN DOOR WITH MICROWAVE LEAKAGE SEAL

[75] Inventor: Gong-Su Kim, Suwon, Rep. of Korea

[73] Assignee: Samsung Electronics Co., Ltd., Suwon, Rep. of Korea

[21] Appl. No.: 08/922,395

[22] Filed: Sep. 3, 1997

[30] Foreign Application Priority Data

Feb. 10, 1997 [KR] Rep. of Korea ..... 97-3859

[51] Int. Cl.[6] ..... H05B 6/76

[52] U.S. Cl. ..... 219/741; 219/744; 174/35 GC

[58] Field of Search ..... 219/741, 742, 219/743, 744, 739, 740, 756; 174/35 MS, 35 GC, 35 R

[56] References Cited

U.S. PATENT DOCUMENTS

| | | | |
|---|---|---|---|
| 3,210,512 | 10/1965 | Eason . | |
| 3,304,401 | 2/1967 | Long . | |
| 3,866,009 | 2/1975 | Ishino et al. | 219/741 |
| 4,535,565 | 8/1985 | Erickson | 219/741 |
| 4,602,141 | 7/1986 | Naito et al. | 219/744 |
| 4,713,511 | 12/1987 | Katoh | 219/741 |
| 4,868,358 | 9/1989 | Yamasaki | 219/744 |

FOREIGN PATENT DOCUMENTS

| | | |
|---|---|---|
| 1 906 621 | 9/1970 | Germany . |
| 428 029 | 7/1967 | Switzerland . |
| 998 390 | 7/1965 | United Kingdom . |

*Primary Examiner*—Philip H. Leung
*Attorney, Agent, or Firm*—Burns, Doane, Swecker & Mathis, L.L.P.

[57] ABSTRACT

A microwave oven includes a main body forming a cooking chamber, and a door hinged to the main body. A rear side of the door includes an endless choke groove and a sealing member surrounding the choke groove. The sealing member is biased by a spring into contact with the main body to prevent a leakage of microwaves therebetween.

3 Claims, 4 Drawing Sheets

MICROWAVE OVEN DOOR WITH MICROWAVE LEAKAGE SEAL

BACKGROUND OF THE INVENTION (1) Field of the Invention

The present invention generally relates to a microwave oven which cooks food utilizing microwave frequencies produced by a magnetron. More particularly, it relates to a microwave oven which has a door of improved structure for opening and closing a cooking chamber of the microwave oven.

(2) Description of the Prior Art

Generally, a microwave oven is a cooking appliance which cooks food by frictional heat generated by making the molecules of the food being cooked move at high speeds utilizing high frequency energy.

FIG. 3 is a sectional view of the overall construction of a conventional microwave oven. As shown in the drawing, the conventional microwave oven includes a main body 10, a cooking chamber 20 and an electrical component compartment 30, both provided to the interior of the main body 10. The cooking chamber 20 of the main body 10 has an open side, and a door 40 is hinged on a front panel 10*a* of the main body 10 along one edge of the opening for opening and closing the open side of the cooking chamber 20. A latch member 41 is formed on a rear side of the door 40 facing the main body 10, the latch member 41 corresponding to a latch lock assembly 43 provided on the front panel 10*a* of the main body 10. The latch member 41 locks within the latch lock assembly 43 to firmly secure the door 40 in a closed position, and is unlocked by user manipulation of a release member 45, provided to one side of the door 40 when the same is closed.

The electrical component compartment 30 is provided to one side of the cooking chamber 20. In the electrical component compartment 30 are formed a magnetron 31 for producing high frequency energy and providing the same to the cooking chamber 20, a high voltage transformer 32 applying high voltage across the magnetron 31, and a fan 33 for cooling the electrical components during operation. A control panel 34 is mounted to one side of the closed door 40. Reference numerals 21 and 42 designate a disk-shaped tray and a window, respectively, the window formed on a middle portion of the door 40 to let a user see the inside of the cooking chamber 20 during operation of the microwave oven.

In the conventional microwave oven, if a user operates the control panel 34 after placing foodstuff on the tray 21 of the cooking chamber 20 and closing the door 40, the magnetron 31, provided in the electrical component compartment 30, supplies microwave frequencies of 2,450 MHz to the cooking chamber 20. The microwave frequencies make the molecules of the food being cooked move at high speeds, thereby cooking or heating the food.

However, in the microwave oven structured as in the above, it is possible for the microwave frequencies provided to the cooking chamber 20 by the magnetron 31 to leak out of the cooking chamber 20 through a gap between the door 40 and the main body 10. This leakage of microwave frequencies, even if it is slight, can interfere with other electronic devices and is harmful to humans. Therefore, laws strictly regulate manufacturing standards to allow only a minimal level of microwave frequency leakage.

Accordingly, as shown in FIG. 4, prior art microwave ovens include a choke assembly 50 provided on the door 40 for inhibiting microwave frequency leakage (FIG. 4 depicts the door 40 contacting the front panel 10*a* of the main body 10 when the door 40 is closed) . The choke assembly 50 includes a choke groove 51 formed on the rear side of the door 40, and a seal 52 made by injection-molding using a plastic material. The seal 52 closes an opening of the choke groove 51. Accordingly, the microwave frequencies are prevented from leaking out of the cooking chamber 20 by entering the choke groove 51 via its opening, and being mutually offset and compensated therein, thus eliminating microwave frequency leakage.

However, high frequencies having a short wavelength are created inside the choke assembly 50, and these may easily leak out through small gaps due to their short wavelength. If the front panel 10*a* of the main body 10 and the rear side of the door 40 are not formed flat, a large gap is created therebetween, thus causing an increase in the amount of high frequencies that leak out of the microwave oven. Thus, there is a limit to the prevention of high frequency leakage by the use of the choke groove 51 formed on the door 40.

SUMMARY OF THE INVENTION

The present invention relates to a microwave oven that can obviate the defects and disadvantages of the conventional technique.

It is an objective of the present invention to provide a microwave oven having a sealing plate which is formed on the back of a door of the microwave oven and elastically supported to expose its rear end outwardly, whereby the exposed rear end is biased into contact with a front panel of the microwave oven when the door is closed, thus preventing a gap from being created therebetween.

In order to obtain the above-mentioned objective of the present invention, there is disclosed a microwave oven including a main body with a cooking chamber having an open side to which microwave frequencies are provided, and a door for opening and closing the cooking chamber and having a rear side facing a front panel of the main body, further including a sealing member formed at the rear of the door and elastically biased against the front panel of the main body when the door is closed, thus preventing microwave frequencies from leaking out of the cooking chamber. The sealing member includes a sealing plate with a rear end protruding from the rear side of the door toward the front panel of the main body; and an elastic member installed in the door and elastically supporting the sealing plate such that the rear end of the sealing plate comes into contact with the front panel of the main body. An opened race is formed on the rear side of the door into which the sealing plate fits, and the sealing plate has stop projections for preventing the sealing plate from being dislodged from the opened race.

The elastic member is preferably a coil spring, and the door carries a rod to maintain the elastic member in its fixed position.

BRIEF DESCRIPTION OF THE DRAWINGS

Further objects and other advantages of the present invention will become apparent from the following description in conjunction with the attached drawings, in which.

DETAILED DESCRIPTION OF A PREFERRED EMBODIMENT OF THE INVENTION

A preferred embodiment of the present invention will be described in detail with reference to the accompanying drawings.

Figure 1:
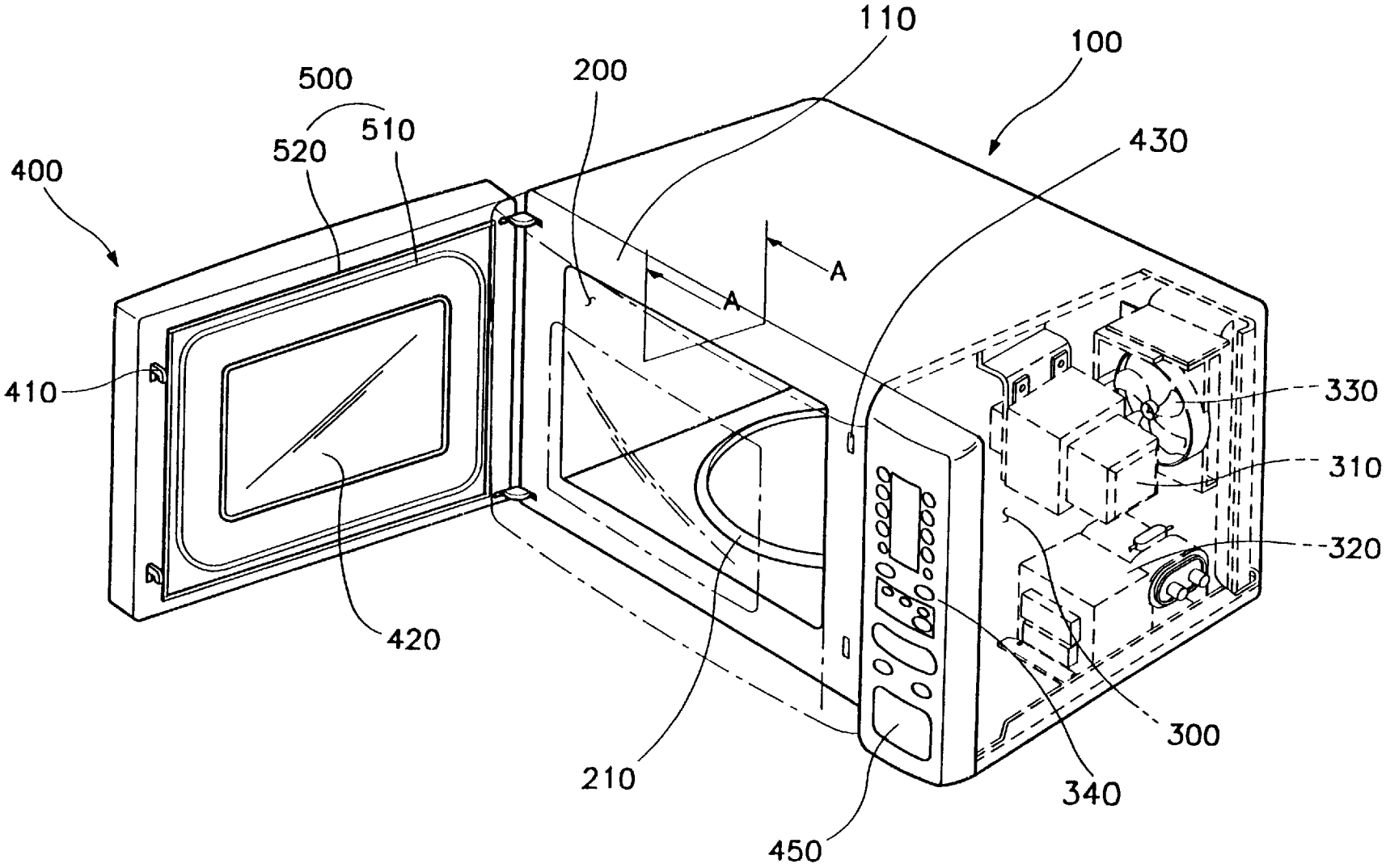
FIG. 1 is a top front perspective view of the overall structure of a microwave oven in accordance with the present invention.

As shown in FIG. 1, a microwave oven of the present invention includes a main body 100 forming the outer appearance of the microwave oven, and a cooking chamber 200 with an open side and an electrical component compartment 300. Both the cooking chamber 200 and the electrical component compartment 300 are inside of the main body 100. The cooking chamber 200 is separated from the electrical component compartment 300. In the electrical component compartment 300 are mounted a magnetron 310 for generating microwave frequencies and providing the same to the cooking chamber 200, a high voltage transformer 320 for applying high voltage across the magnetron 310, and a fan 330 for cooling the electrical components. Reference numerals 210 and 340 designate a disk-shaped tray and a control panel, respectively.

A door 400 includes a door body hinged on a front panel 110 of the main body 100 such that the door 400 can open and close the cooking chamber 200. A latch member 410 is mounted on a portion of the door body at a location corresponding to a location of a latch hook assembly 430 provided on the front panel 110 of the main body 100. The latch member 410 locks within the latch lock assembly 430 to firmly secure the door 400 in a closed position, and is unlocked by user manipulation of a release member 450, provided to one side of the closed door 400. A window 420 is provided in the door body to allow users to view into the cooking chamber 200. Disposed on the rear side of the door body is a choke assembly 500 cooperating with the front panel 110 for preventing leakage of microwave frequencies from the cooking chamber 200. This choke assembly 500-consists of an endless (rectangular) choke groove 510, formed in the rear side of the door body, and an endless (e.g., rectangular) sealing member 520 mounted in the door body and biased into contact with the front panel 110 of the main body 100 when the door 400 is closed to prevent the microwave frequency leakage.

Figure 2:
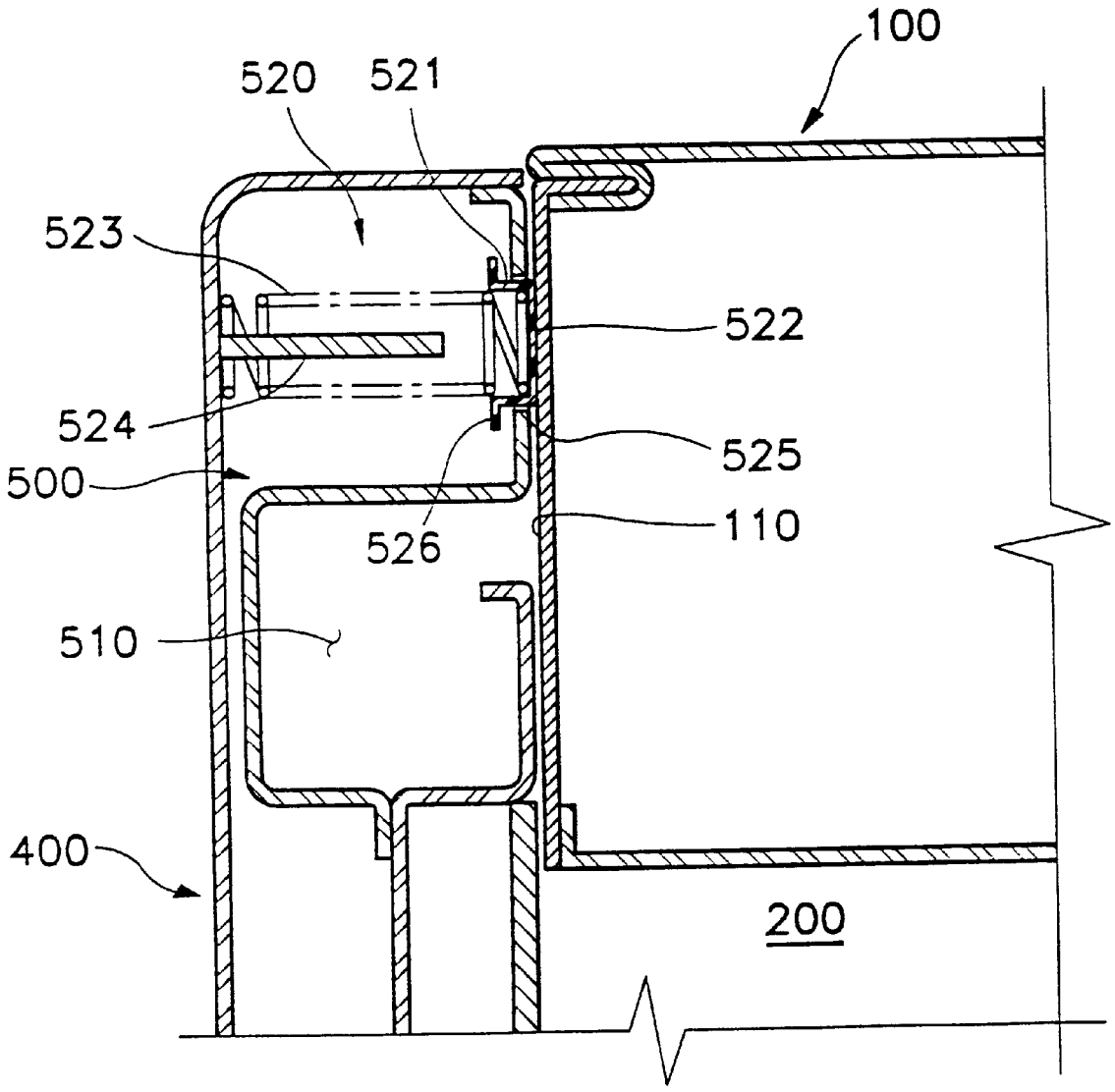
FIG. 2 is a sectional view taken along line A—A of FIG. 1, and depicts a door of the microwave oven, contacting a main body for closing a cooking chamber in accordance with the present invention.
Figure 3:
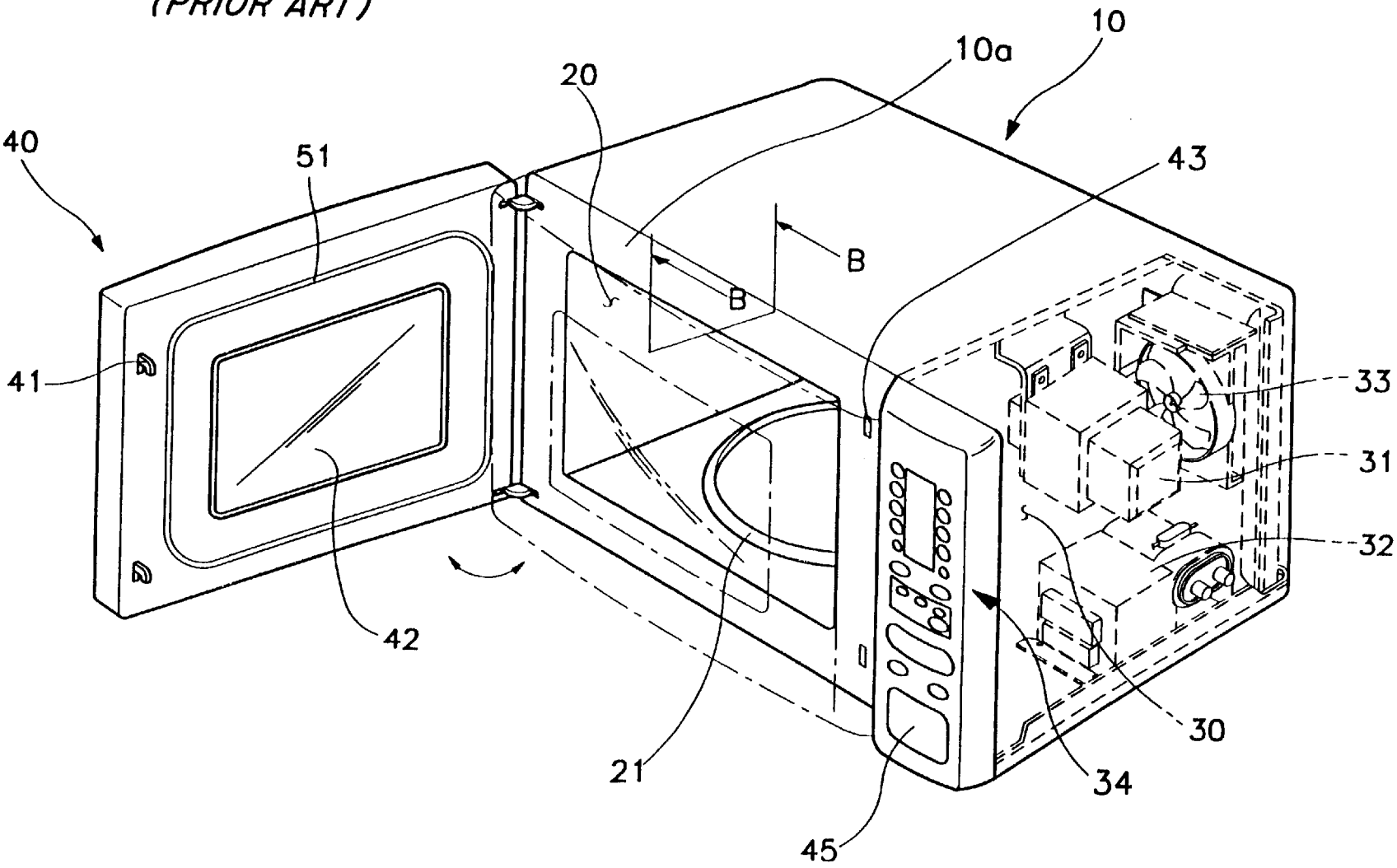
FIG. 3 (PRIOR ART)
FIG. 3 is a top front perspective view of a conventional microwave oven.
Figure 4:
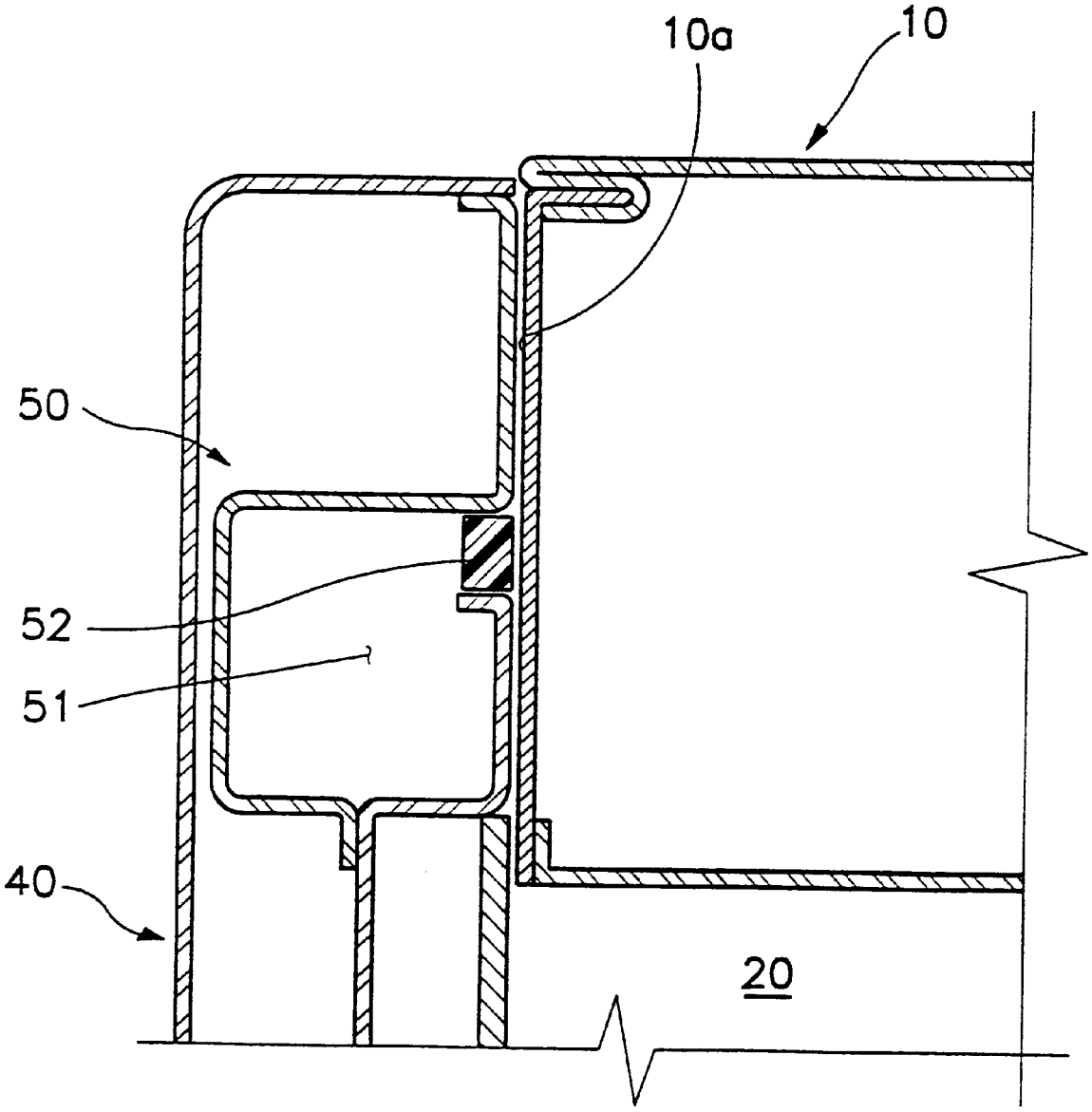
FIG. 4 (PRIOR ART)
FIG. 4 is a sectional view taken along line B—B of FIG. 3, and depicts a door of the microwave oven, contacting a main body for closing a cooking chamber.

The sealing member 520 is formed to the outside of (i.e., it surrounds) the choke groove 510, and this construction will be described in detail with reference to FIG. 2. As shown in the drawing, there is formed on the rear side of the door body an endless opening or race 525. The sealing member 520 includes a sealing plate 521 having a rear end 522 protruding toward the front panel 110 of the main body 100. An elastic member 523 elastically biases the sealing plate 521 in the rearward direction. Since the elastic member 523, installed in the door body, applies a rearward biasing force to the sealing plate 521, the rear end 522 of the sealing plate 521 protrudes toward the front panel 110 via the opened race 525. Stop projections 526 are formed at upper and lower edges of a front end of the sealing plate 521 for preventing the sealing plate 521 from being dislodged from the opened race 525. A guide member 524 is provided to the inside of the elastic member 523, which is a coil spring, to maintain the spring in a fixed position.

The following description relates to the operation of the microwave oven in accordance with the present invention.

When the door 400 is opened, the rear end 522 of the sealing plate 521 is pushed outwardly through the opened race 525 by the elastic member 523. If a user closes the door 400, the rear end 522 of the sealing plate 521 comes in contact with the front panel 110 of the main body 100, and is displaced forwardly thereby while compressing the spring 523, thus preventing the formation of a gap between the rear side of the door body and the front panel 110. From this state, if the user begins the operation of the microwave oven by manipulating the control panel 340, microwave frequencies of 2,450 MHz are provided in the cooking chamber 200 by the magnetron 310, and then are applied to the food, thus performing cooking or heating operation.

The majority of the microwave frequencies traveling between the door and front panel 110 are introduced to the inside of the choke groove 510 and refracted there to mutually offset each other and be extinguished. Further, through a feature of the present invention, when the door 400 is closed, because the rear end 522 of the sealing plate 521, protruding toward the front panel 110 through the open race 525, is firmly pressed against the front panel 110 of the main body 100, a tight seal is formed and no gap can be created, thereby preventing microwave frequency leakage.

The inventive choke assembly 500 for precluding microwave frequency leakage comprises the sealing member 520 having the choke groove 510, the sealing plate 521, and the elastic member 523 for more completely preventing microwave frequencies from leaking out of the cooking chamber 200.

As fully described above, the microwave oven of the present invention includes the sealing plate formed on the rear side of the door and elastically supported in a manner that its rear end is outwardly exposed, and as the door is closed, the rear end of the sealing plate contacts the front panel of the main body, thus eliminating a gap therebetween. Accordingly, this structure stops the microwave frequencies from leaking out between the rear side of the door and the main body.

What is claimed is:

1. A microwave oven comprising:

a main body forming a cooking chamber, and including a front panel;

a magnetron for providing microwave frequencies to the cooking chamber; and a door for opening and closing the cooking chamber, the door comprising:

a door body hinged to the main body, the door body including a rear side facing rearward is toward the front panel when the door is in a closed state; and a sealing member mounted on the door body and elastically biased rearwardly into contact with the front panel when the door is closed, for resisting leakage of microwave frequencies therebetween, the sealing member surrounding a front opening of the cooking chamber, a coil spring yieldably biasing the sealing member rearwardly such that a rear face thereof protrudes rearwardly beyond the rear side of the door body, a guide rod fixed to the door body and disposed within the coil spring to retain the coil spring in position.

2. The microwave oven according to claim 1, wherein the rear side of the door body includes an endless opening through which the sealing member projects, the sealing member including stop projections for preventing the sealing member from being dislodged rearwardly through the opening.

3. A microwave oven comprising:

a main body forming a cooking chamber, and including a front panel;

a magnetron for providing microwave frequencies to the cooking chamber; and a door for opening and closing the cooking chamber, the door comprising:

a door body hinged to the main body;

a choke groove formed in a rear side of the door body, the choke groove including a first endless opening facing the front panel when the door is closed;

a second endless opening formed in the rear side of the door body in surrounding relationship to the first endless opening;

an endless sealing member mounted on the door body and projecting rearwardly through the second endless opening;

a coil spring elastically biasing a rear face of the sealing member rearwardly into contact with the front panel when the door is closed, for resisting leakage of microwave frequencies therebetween; and a guide rod fixed to the door body and disposed within the coil spring to retain the coil spring in position.

* * * * *